United States Patent [19]

Forman

[11] 4,243,992

[45] Jan. 6, 1981

[54] METHOD AND APPARATUS FOR FABRICATING A WIDEBAND WHIP ANTENNA

[75] Inventor: Donald B. Forman, San Diego, Calif.

[73] Assignee: The United States of America as represented by the Secretary of the Navy, Washington, D.C.

[21] Appl. No.: 30,187

[22] Filed: Apr. 16, 1979

[51] Int. Cl.[3] ..... G08B 13/00

[52] U.S. Cl. ..... 343/873; 343/715

[58] Field of Search ..... 343/711-715, 343/749, 750, 900, 872, 873

[56] References Cited

U.S. PATENT DOCUMENTS

| | | | |
|---|---|---|---|
| 2,403,093 | 7/1946 | Lear | 343/873 |
| 2,982,964 | 5/1961 | Bresk et al. | 343/750 |
| 3,103,011 | 9/1963 | Seeley | 343/749 |
| 3,541,567 | 11/1970 | Francis et al. | 343/873 |
| 3,594,810 | 7/1971 | Kaloi | 343/895 |
| 3,631,499 | 12/1971 | Turner | 343/701 |
| 3,699,452 | 10/1972 | Lindenmeier et al. | 343/701 |
| 3,825,933 | 7/1974 | Debski et al. | 343/895 |
| 3,828,353 | 8/1974 | Majkrzak et al. | 343/873 |

*Primary Examiner*—David K. Moore

*Attorney, Agent, or Firm*—Richard S. Sciascia; Ervin F. Johnston; George J. Rubens

[57] ABSTRACT

A wideband whip antenna is fabricated by a method which enables the antenna to have a thinner profile, be lighter in weight, and much more flexible in that the radiating conductors are mounted in a plastic antenna core in a manner to be movable freely longitudinally therein when doubled without damage to their electrical continuity.

9 Claims, 5 Drawing Figures

METHOD AND APPARATUS FOR FABRICATING A WIDEBAND WHIP ANTENNA

CROSS-REFERENCE TO RELATED APPLICATIONS

This application is related to a U.S. Patent Application Ser. No. 017,749 filed on Mar. 5, 1979 by Douglas M. Dilley for "Wideband VHF Antenna".

BACKGROUND OF THE INVENTION

This invention relates to wideband whip-type antennas, and more particularly to a method and apparatus for manufacturing such type antennas. The above described related patent application describes the disadvantages of currently used whip-type antennas on military vehicles, especially on Command communication jeeps. Such antennas are thick, somewhat rigid, and lengthy making them more visible to enemy forces, and subject to damage by hitting trees, etc. Furthermore, the construction of these prior art antennas do not make them suitable for rugged field use in which they are normally employed.

SUMMARY OF THE INVENTION

A novel method of manufacturing wideband whip antennas enables them to be made shorter, thinner and more flexible so they are less visible and better able to withstand rugged field use. The method utilizes preferably a solid fiberglass extruded rod having longitudinally extending fibers, being the antenna core. As the rod is usually extruded of uniform diameter, it may be tapered to the desired dimensions by a conventional grinding operation. Thereafter, a plurality of spaced, longitudinal grooves are cut in the periphery of the rod by a unique broaching apparatus which also forms a part of this invention. The novel broaching apparatus can be adjusted to cut the grooves on the tapered surface to a predetermined and uniform selected depth.

The radiating conductors, preferably of a braided construction, are coated with a casting release agent, having the consistency of a gel. The coated conductors are then loosely laid into their respective grooves, being retained therein by the release agent. In a final step, a fiberglass tape impregnated with resin is wrapped around the rod with the conductors housed in their grooves and cured in an oven.

OBJECTS OF THE INVENTION

A principal object of this invention is to provide a method for manufacturing a wideband whip antenna which is shorter, thinner, more flexible, and less expensive to construct.

Another important object of this invention is to provide a broaching apparatus which will enable longitudinal grooves to be cut on the periphery of a tapered rod.

Other objects, advantages and novel features of the invention will become apparent from the following detailed description of the invention when considered in conjunction with the accompanying drawings.

DESCRIPTION OF THE PREFERRED EMBODIMENT

Figure 1:
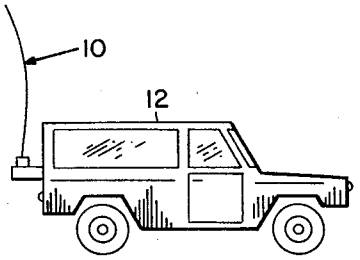
FIG. 1 is a side elevation of a wideband whip antenna mounted on a typical vehicle.
Figure 2:
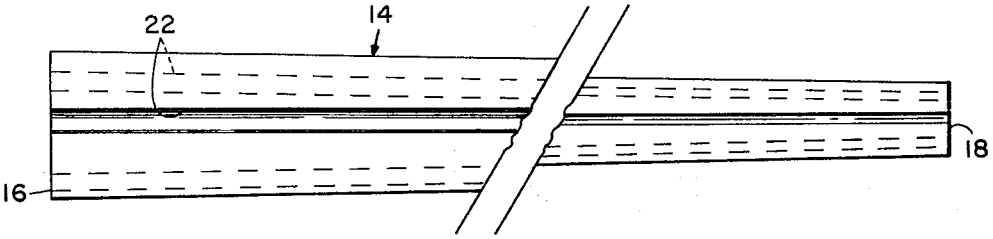
FIG. 2 is an enlarged side elevation of a grooved tapered rod which forms the antenna core.

Referring to FIG. 1, a wideband whip antenna 10 is shown mounted on a typical field-type vehicle, such as a Marine Corps Command communication jeep 12 on which as many as eight antennas may be mounted. The novel method of this invention produces a shorter and highly flexible antenna to enable it to withstand the rough field treatment by striking tree limbs and the like, and to have a minimum profile to be less visible to enemy forces for identification of the Command-type vehicle.

The novel method utilizes a selected length of a solid extruded fiberglass rod 14 as a core, having its fibers oriented longitudinally the rod to achieve maximum bending strength. The length of the rod will depend on the length of the radiating elements to be housed in the antenna as is fully described in the above identified related patent application. In the example cited therein rod 14 is seventy-one inches long.

Figure 3:
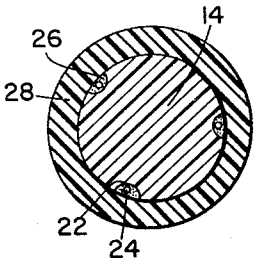
FIG. 3 is a cross-section of a completed antenna fabricated according to the present invention.

Thereafter, plastic rod core 14 can be tapered by a conventional grinding operation (not shown) to the desired dimensions, i.e. a ¼-inch diameter at the base end 16 and 3/16-inch diameter at the tip end 18. The tapered core is then drawn through broaching apparatus 20, later to be described in detail, to form grooves 22 longitudinally into the periphery of the rod, each groove to house a predetermined length of a radiating conductor 24. As shown in FIG. 3, grooves 22 are cut uniformly spaced around the periphery.

An important feature of this invention is to construct an antenna in which the embedded radiating conductors 24 are free to slide longitudinally in their grooves relative to rod 14 when the antenna is severely bent upon itself. This is achieved by coating conductors 24 prior to their assembly into the antenna with a gel-like substance 26, which can be a commercially available release agent commonly used in the casting art. To further enhance the flexibility of the antenna, conductors 24 are of a braided construction so as to be more stretchable than solid wire. Release agent 26 also enables conductors 24 to remain assembled in its respective groove during the remaining fabrication process.

An outer protective jacket 28 is provided for the antenna by wrapping a resin impregnated fiberglass cloth around rod 14 enclosing conductors 24 within their respective grooves. The assembled wrapped rod is then cured in an oven, depending on the materials, at a temperature of 260°–270° F. for about 4 hours.

Jacket 28 tightly adheres to the peripheral surface of rod 14 except at the area of the grooves 22 where it forms a skin thereover. Accordingly, conductors 24 with the aid of release agent 26 are free to stretch longitudinally within the groove relative to both core 14 and jacket 28 when a tension is applied thereto when the antenna is bent.

After curing, a weatherproof coating of epoxy paint (not shown) may be applied to the outer surface of jacket, and the rod attached in a conventional manner to a supporting base (not shown).

Figure 5:
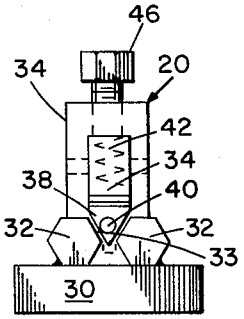
FIG. 5 is an end view of the broaching apparatus of FIG. 4.
Figure 4:
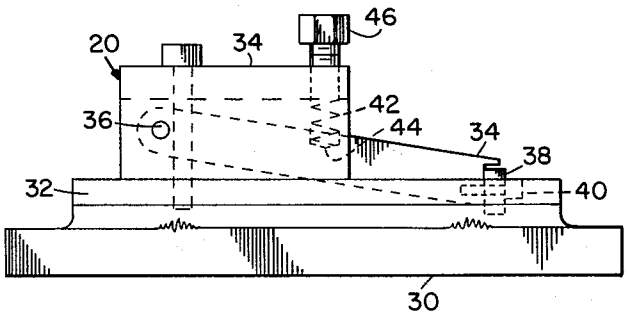
FIG. 4 is a side elevation of a novel broaching apparatus.

Apparatus 20 for broaching longitudinal grooves 22 in core 14 is shown in FIGS. 4 and 5, and comprises a base 30 suitable for support on a workbench or the like. Welded to the top surface of the base is a pair of spaced hexagonal rod-shaped guides 32 forming therebetween V-shaped recess 33 which is adapted to support a rod core 14 (not shown) for broaching. An inverted channel-shaped support 34 is welded or otherwise secured to the top of work guides 32 and forms a housing for a cutting tool arm 34 which is pivotally mounted thereto at pin 36. Accordingly arm 34 is pivoted in a vertical plane guided within channel support 34. A carbide cutting bit 38 is secured by bolt 40 to the free end of arm 34 being aligned with the centerline of support 34 and recess 33. A coiled compression spring 42 is positioned between the legs of channel support 34 being seated at the lower end in a recess 44 approximately midway on pivotal arm 34 and at the other end abutting adjusting screw 46. Adjustment screw 46 enables the compression of spring 42 to be varied according to the desired depth of grooves 22 to be cut by bit 38.

The novel method of this invention provides for the low cost construction of a wideband whip antenna which is shorter in length, more flexible, and more durable for rugged field use, and which is more slender offering a low profile to enemy forces to reduce visibility and to make it more difficult for them to identify a Command vehicle on which usually a plurality of such whip antennas are mounted. The assembly method of forming and curing the fiberglass jacket directly on the extruded rod core eliminates several steps in the production process, and obviates the need to control dimensional tolerances to the degree required where the core and jacket are fabricated separately, to reduce the cost of manufacturing.

Obviously many modifications and variations of the present invention are possible in the light of the above teachings. It is therefore to be understood that within the scope of the appended claims the invention may be practiced otherwise than as specifically described.

What is claimed is:

1. A method of fabricating a highly flexible, low profile, wideband whip antenna comprising the steps of:

fabricating a solid rod of highly flexible material having a plurality of longitudinal open grooves spaced around its periphery;

inserting radiating elements into respective grooves on said rod of a size so as to be loosely positioned therein; and bonding an outer protective jacket to the periphery of said rod whereby the radiating elements are free to slide longitudinally within their respective grooves between the rod and jacket when the rod is bent.

2. The method of claim 1 wherein said rod is fabricated of fiberglass by an extrusion process, and the radiating elements are coated with a release agent to ensure freedom of longitudinal movement in their respective grooves, said radiating elements being housed entirely within their respective grooves.

3. The method of claim 2 wherein said grooves are formed equally spaced around the rod periphery.

4. The method of claim 2 wherein said radiating elements are made of braided wire.

5. The method of claim 2 wherein the fabrication step includes the step of broaching said grooves in the periphery of the rod.

6. The method of claim 1 wherein the fabrication step includes the step of longitudinally tapering the rod.

7. The method of claim 1 wherein said outer protective jacket is bonded by curing.

8. The method of claim 2 wherein is added the step of tapering the rod by grinding before the radiating elements are inserted into their respective grooves.

9. A method of fabricating a highly flexible, low profile, wideband whip antenna from a tapered rod made of highly flexible insulating material comprising the steps of:

forming a plurality of longitudinal grooves in the periphery of said rod;

inserting a radiating element in each of said grooves; and covering said grooves in a manner to allow said radiating elements freedom to move longitudinally within their respective grooves.

* * * * *